US006719066B2

(12) United States Patent
Haringer

(10) Patent No.: US 6,719,066 B2
(45) Date of Patent: Apr. 13, 2004

(54) CONSTRUCTION VEHICLE WITH A WORKING APPLIANCE

(75) Inventor: Alois Johann Haringer, Neumarkt (IT)

(73) Assignee: macmoter S.p.A., Modigliana (IT)

( * ) Notice: Subject to any disclaimer, the term of this patent is extended or adjusted under 35 U.S.C. 154(b) by 0 days.

(21) Appl. No.: 10/108,942

(22) Filed: Mar. 26, 2002

(65) Prior Publication Data

US 2002/0139545 A1 Oct. 3, 2002

(30) Foreign Application Priority Data

Mar. 29, 2001 (DE) ..... 101 16 578

(51) Int. Cl.[7] ..... E02F 3/815

(52) U.S. Cl. ..... 172/821; 172/824; 172/795; 37/234

(58) Field of Search ..... 172/818, 819, 172/820, 821, 822, 824, 795; 37/234

(56) References Cited

U.S. PATENT DOCUMENTS

| | | | | | |
|---|---|---|---|---|---|
| 3,645,340 | A | * | 2/1972 | Frisbee | 172/812 |
| 3,759,110 | A | * | 9/1973 | Davis | 74/99 R |
| 4,074,770 | A | * | 2/1978 | Frisbee | 172/813 |
| 4,076,080 | A | * | 2/1978 | Anderson | 172/821 |
| 4,081,036 | A | * | 3/1978 | Yokoyama | 172/821 |
| 4,083,414 | A | * | 4/1978 | Yokoyama et al. | 172/821 |
| 4,248,311 | A | * | 2/1981 | Frisbee et al. | 172/819 |
| 4,270,617 | A | * | 6/1981 | Cantarella et al. | 172/821 |
| 4,281,721 | A | * | 8/1981 | Beales | 172/821 |
| 4,405,019 | A | * | 9/1983 | Frisbee | 172/816 |
| 4,562,891 | A | * | 1/1986 | Ranner | 172/821 |
| 4,828,044 | A | | 5/1989 | Horsch et al. | |
| 4,828,045 | A | * | 5/1989 | Horsch et al. | 172/821 |
| 5,285,588 | A | * | 2/1994 | Niemela et al. | 37/234 |
| 5,507,352 | A | * | 4/1996 | Frisbee et al. | 172/818 |
| 5,634,523 | A | | 6/1997 | Kobayashi et al. | |
| 5,706,591 | A | * | 1/1998 | Wissmiller | 37/231 |
| 5,813,476 | A | * | 9/1998 | Semper | 172/822 |
| 5,870,839 | A | * | 2/1999 | Wissmiller | 37/231 |
| 5,899,007 | A | * | 5/1999 | Niemela et al. | 37/281 |
| 6,178,669 | B1 | * | 1/2001 | Quenzi et al. | 37/231 |
| 6,276,076 | B1 | * | 8/2001 | Quenzi et al. | 37/231 |
| 6,393,737 | B2 | * | 5/2002 | Quenzi et al. | 37/231 |
| 2001/0047600 | A1 | * | 12/2001 | Quenzi et al. | 37/270 |

FOREIGN PATENT DOCUMENTS

| | | | | |
|---|---|---|---|---|
| EP | 1245740 | A1 | * 10/2002 | E02F/3/76 |

* cited by examiner

*Primary Examiner*—Robert E. Pezzuto
*Assistant Examiner*—Alexandra Pechhold
(74) *Attorney, Agent, or Firm*—W. F. Fasse; W. G. Fasse

(57) ABSTRACT

A construction vehicle has a working appliance such as a blade, which is mounted on a vehicle frame such that it can pivot in the vertical direction about a first axis and it can pivot about a second axis substantially perpendicular thereto, for which purpose at least one hydraulic device is provided. The position of the axis about which the working appliance can pivot can be varied in relation to the vehicle frame.

11 Claims, 6 Drawing Sheets

CONSTRUCTION VEHICLE WITH A WORKING APPLIANCE

FIELD OF THE INVENTION

The invention relates to a construction vehicle with a working appliance, in particular a blade, which is mounted on a carrier such that it can pivot about a vertical axis, the carrier being mounted on the vehicle frame such that it can be pivoted in the vertical direction about a horizontal axis, it being possible for the pivoting movements to be carried out by means of hydraulic devices.

BACKGROUND INFORMATION

The construction vehicle can have a chassis with caterpillar tracks or with tired wheels. If it is a vehicle with caterpillar tracks, then it is generally necessary to transport said vehicle to the respective building site on a low-loader. Construction vehicles provided with wheels can also themselves be driven to the building sites, although this is normally inexpedient. Thus, construction vehicles with wheels are likewise transported on low-loaders, depending on the distances to be managed. During such transport, the width of the working appliance plays a major part. For example, it occurs again and again that the working appliance, for example a blade with a length which exceeds the vehicle width, has too great a width, so that it has to be dismantled before being transported and subsequently refitted. This entails a great deal of effort.

U.S. Pat. No. 5,634,523 discloses not only the construction vehicle with a blade described at the beginning, but also already provides for the blade exceeding the vehicle width to be attached to the carrier with a vertical axis off-center, at a lateral distance from the longitudinal mid-plane of the vehicle, so that the blade can be pivoted about this vertical axis into a transport position, in which the blade is located within the vehicle width, without a carrier that extends excessively far forward or a vertical axis arranged at a relatively large distance in front of the vehicle having to be provided for the blade. The distance between the vertical axis and the longitudinal mid-plane of the vehicle cannot be varied, however. This means that during operation asymmetrical force distributions occur and have to be absorbed, which has the effect of promoting wear.

SUMMARY OF THE INVENTION

Accordingly, the invention is based on the object of constructing the construction vehicle in such a way that the width can be adapted for transport without disadvantages in operation having to be tolerated for this purpose.

According to the invention, this object is achieved by the vertical axis about which the working appliance can be pivoted being adjustable in the lateral direction between a vertical longitudinal mid-plane running through the vehicle longitudinal axis and a longitudinal plane running at a distance from and parallel to the longitudinal mid-plane.

Although U.S. Pat. No. 4,828,044 discloses a construction vehicle in which the blade is attached to the carrier with a vertical axis arranged in the longitudinal mid-plane of the vehicle, and this axis can be deflected in the transverse direction, in this case the vertical axis is not displaced in parallel fashion but is only tilted toward the side, the axis being held at a lower point by means of a spherical joint in the longitudinal mid-plane and being pivoted out laterally in an upper region. This measure is used for the purpose of adjusting the blade, normally aligned horizontally, in a transverse plane into an oblique position. This has nothing to do with adapting the width for transport purposes.

On the basis of the construction according to the invention, it is possible to change the attachment point of the working appliance for transport purposes. For example, it may be displaced toward the side in such a way that the working appliance can be pivoted on the construction vehicle to a greater extent than hitherto. In order that the position of the pivoting axis for the operating appliance can be moved from its central working position into the lateral transport position, provision is further made for the component serving as a carrier for the working appliance to be mounted on the vehicle side such that it can be pivoted. By this means, a pivoting radius which virtually corresponds to the length of the carrier itself can be achieved. The result of this is that, for example, a blade may be set extremely obliquely in relation to the vehicle longitudinal direction, in spite of direct fixing to the construction vehicle, and as a result needs less space in the width direction.

Further features of the invention emerge from the subclaims and the description in conjunction with the drawing.

BRIEF DESCRIPTION OF THE DRAWINGS

The invention will be explained in more detail below using an exemplary embodiment which is illustrated in the drawing, in which.

Detailed Description of a Preferred Example Embodiment of the Invention

Figure 1:
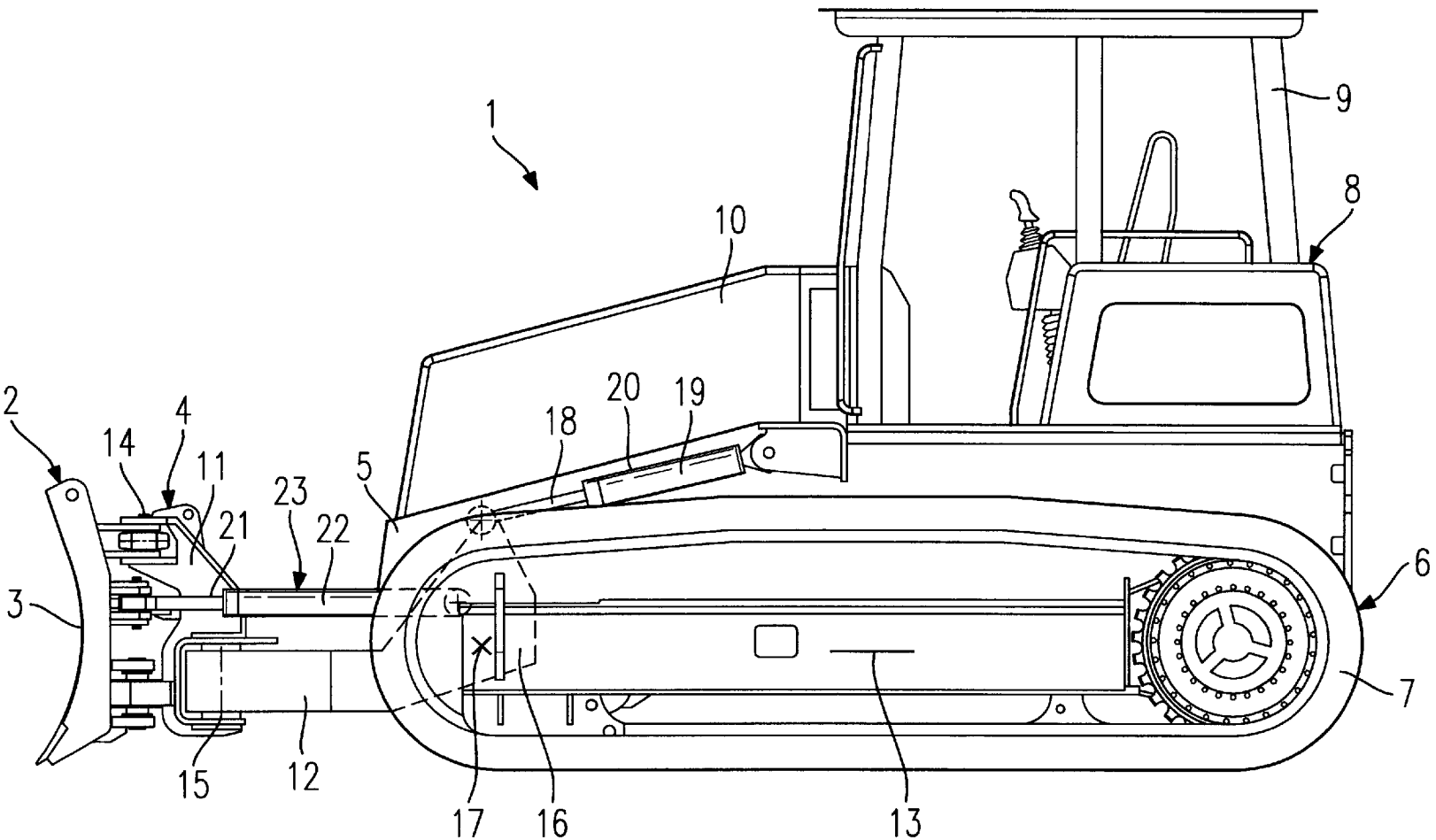
FIG. 1 shows a side view of a construction vehicle having caterpillar tracks and having a blade.

A construction vehicle 1 has, according to FIG. 1, a working appliance 2, which is in particular a planing blade or blade 3 which, with the aid of a carrying and adjusting device 14, is arranged on the vehicle frame 5 and can be moved, that is to say can be pivoted, raised and lowered.

The construction vehicle 1 further comprises a chassis 6 having, for example, two caterpillar tracks 7 and a superstructure 8 having a driver's cab 9 and an engine 10.

The carrying and adjusting device 4 has a carrier 11 and a carrying piece 12 as carrying components for the blade. The blade 3 is attached to the carrier 11 and the carrying piece 12 is attached to the vehicle frame 5. Furthermore, the carrier 11 and the carrying piece 12 are connected to each other such that they can pivot. The attachment of the blade 3 to the carrier 11 is carried out along an axis 14 at right angles to the vehicle longitudinal axis 13 (FIG. 1). The carrier 11 and the carrying piece 12 are connected to each other such that they can pivot about an axis 15 that is parallel to the axis 14, and the carrying piece 12 is mounted on the vehicle frame 5 in the region of lateral cheeks 16 such that it can pivot about a horizontal axis 17. In each case, one cheek 16 is arranged laterally on the outside of the carrying piece 12 and in each case is located on the inside beside the caterpillar tracks 7.

The carrying piece 12 and, with the latter, the carrier 11 and the blade 3 can be raised and lowered about the axis 17. For this purpose, use is made of hydraulic devices 20 comprising piston rod 18 and cylinder 19 on both sides of the construction vehicle 1. The hydraulic devices 20 in each case act on the cheeks 16.

Two further hydraulic devices 23, likewise comprising piston rod 21 and cylinder 22, are attached on both sides to the cheeks 16 and are used to pivot the blade 3 about the axis 14. This situation is illustrated in FIG. 2 and shows that the blade 3 can be pivoted to the right and to the left about the axis 14 from a central position.

In this case, the carrier 11 is located in a central position in relation to the construction vehicle 1 and relative to its vehicle longitudinal axis 13.

Figure 2:
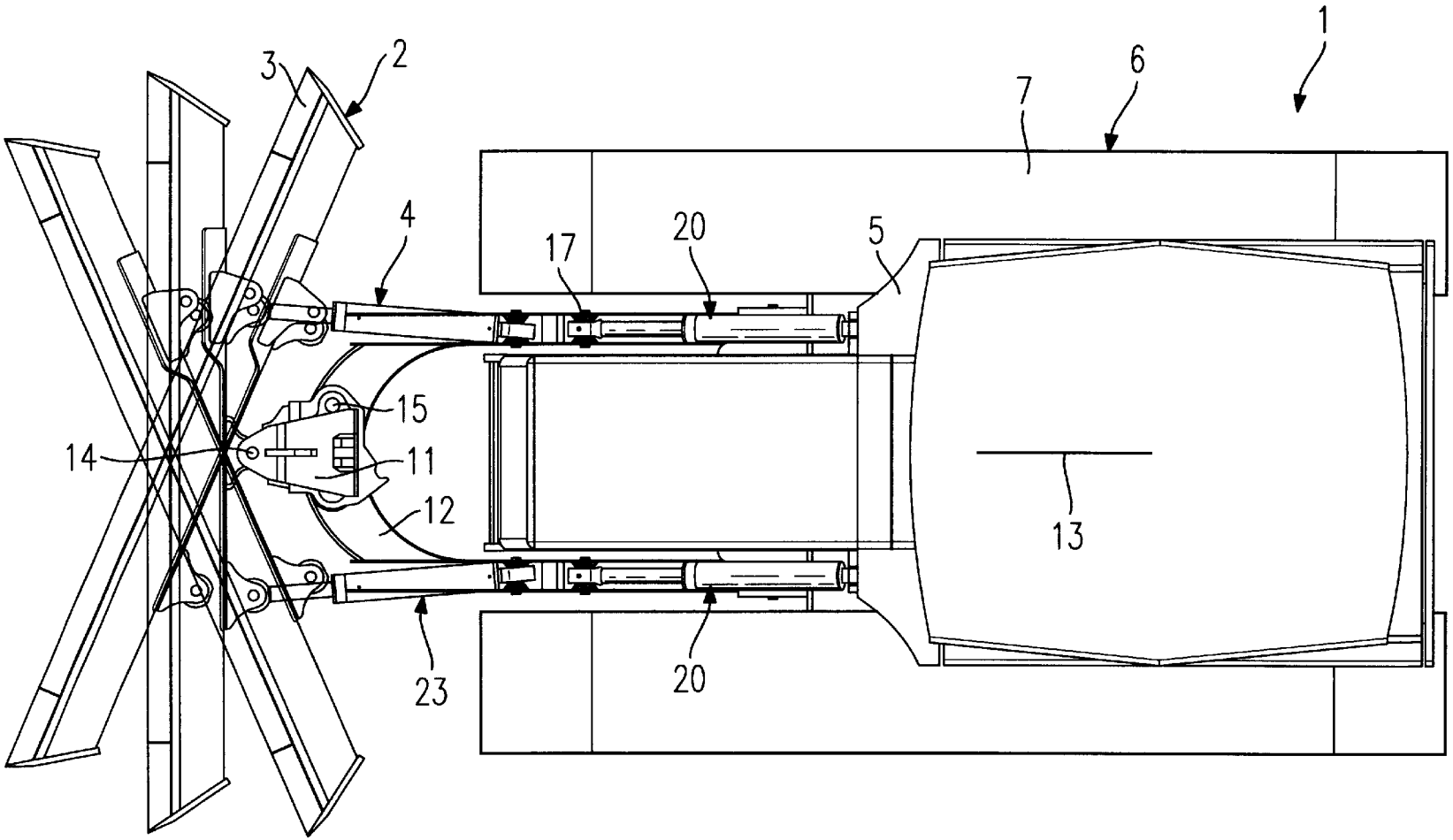
FIG. 2 shows a plan view of the construction vehicle according to FIG. 1

The axis 15, about which the carrier 11 is mounted such that it can pivot on the carrying piece 12, does not intersect the vehicle longitudinal axis 13 (FIG. 2). It is located off center.

In order that the carrier 11 cannot be pivoted about the axis 15 in normal operation, a securing or blocking device 24 (FIG. 3) is also provided. This securing and blocking device 24 either fixes the carrier 11 in the working position on the carrying piece 12 or releases the carrier 11 to be pivoted about the axis 15. This case is illustrated in FIG. 5.

Figure 4:
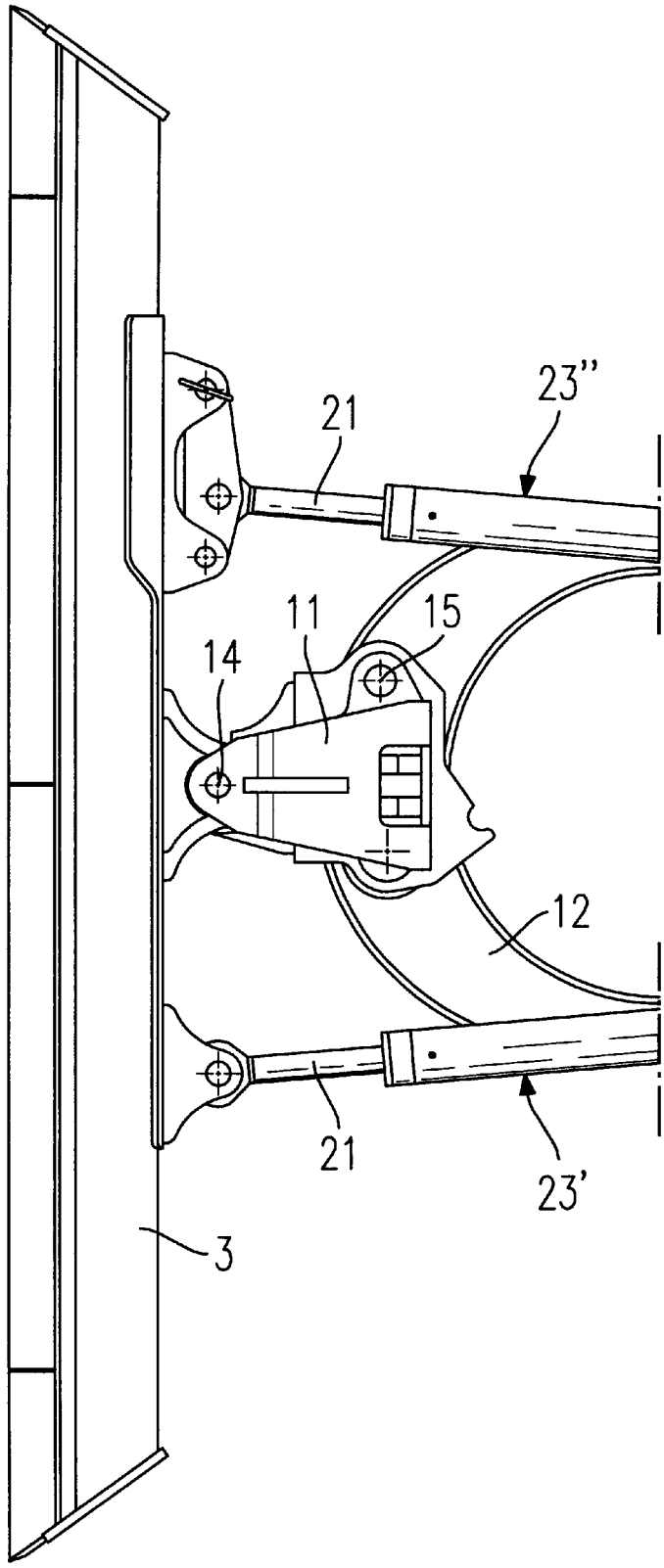
FIG. 4 shows a plan view of the blade and the components carrying it, once more on a different scale.
Figure 5:
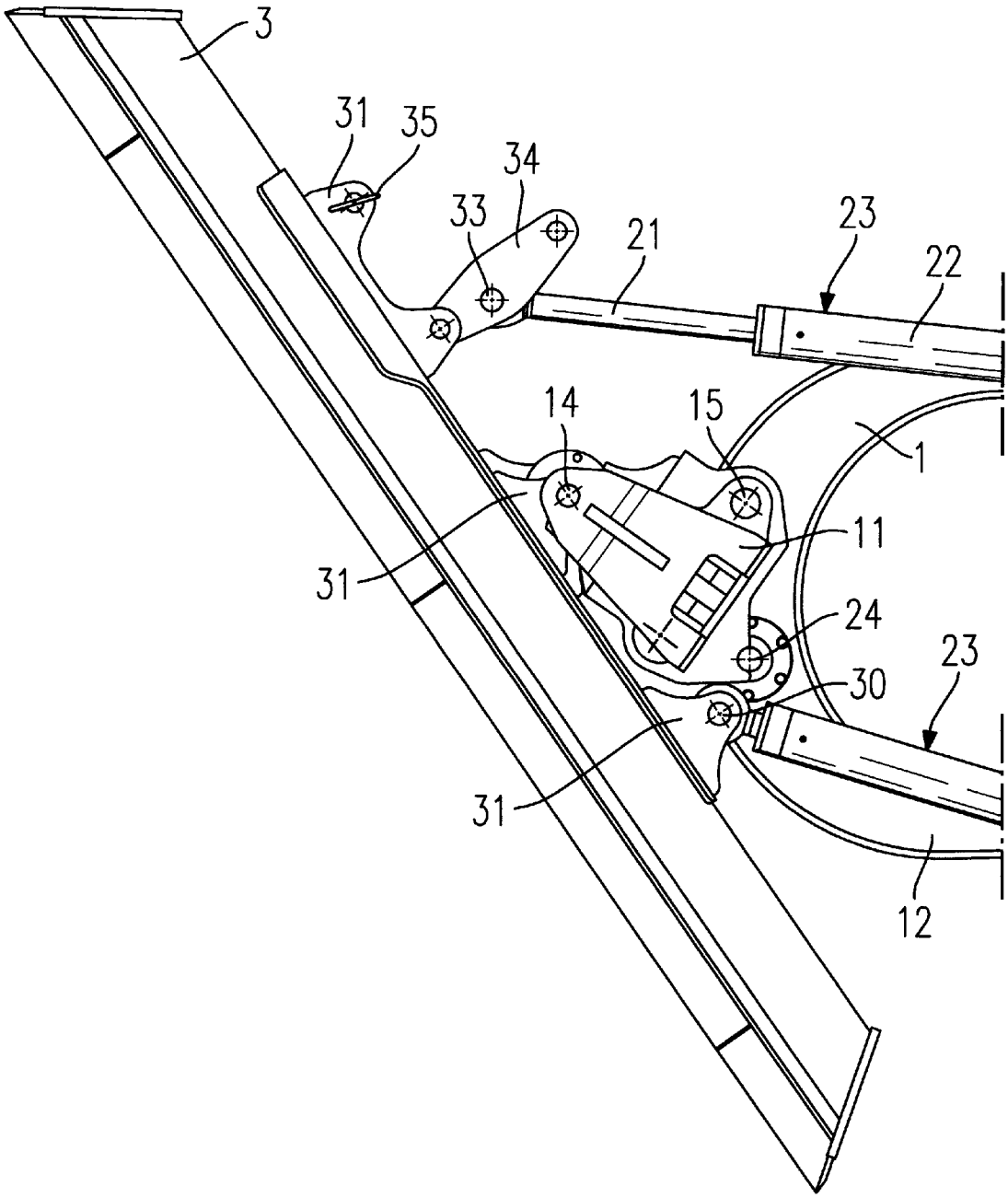
FIG. 5 shows a plan view of the blade according to FIG. 4 in the oblique position.
Figure 8:
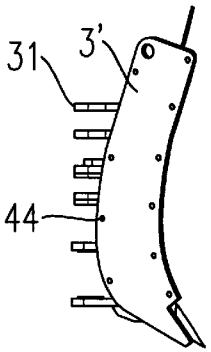
FIG. 8 shows a side view of the blade according to FIGS. 6 and 7.
Figure 6:
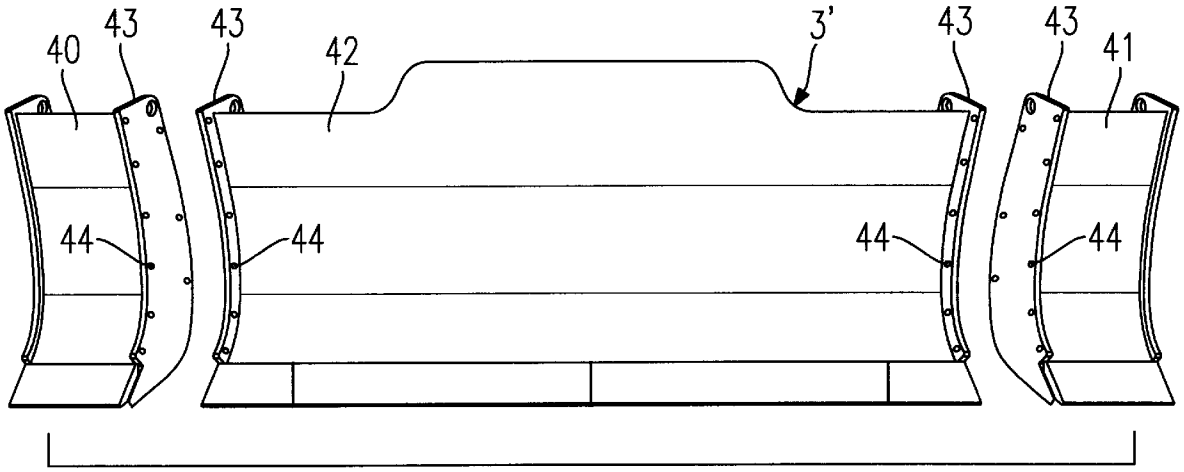
FIG. 6 shows a view of an extendable blade before assembly.
Figure 7:
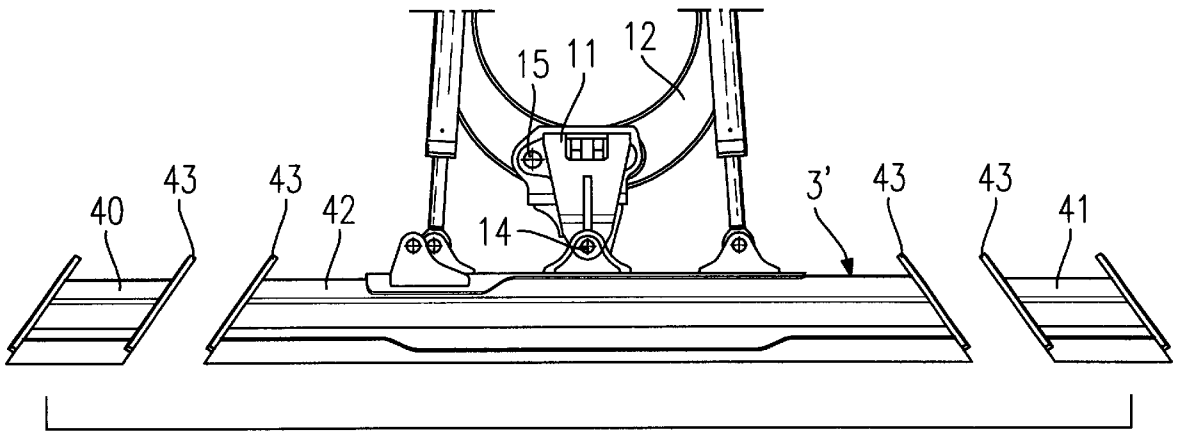
FIG. 7 shows a plan view of the blade according to FIG. 6 before assembly.

As soon as the securing and blocking device 24 releases the carrier 11, it can be pivoted about the axis 15 from the position according to FIG. 4 into the position according to FIG. 5. In the process, the axis 14 moves out of its central position from the vehicle longitudinal axis 13 or from the vertical vehicle mid-plane toward one side of the construction vehicle 1. At the same time, the piston rod 21 of one hydraulic device 23' (FIG. 4) can be retracted and the other piston 21 of the other piston-cylinder device 23" can be extended to the maximum (FIG. 5), so that the blade 3 comes into an extreme position oriented to the left. It now assumes only a low width relative to the width of the construction vehicle 1.

The securing and blocking device 24 expediently comprises at least one pin 25 serving the purpose of blocking or, according to the exemplary embodiment, two pins 25 (FIG. 3) serving the purpose of blocking and a hydraulic device 26, which either slides the pins 25 into retaining openings 27 on the carrier side or withdraws them from the latter.

Figure 3:
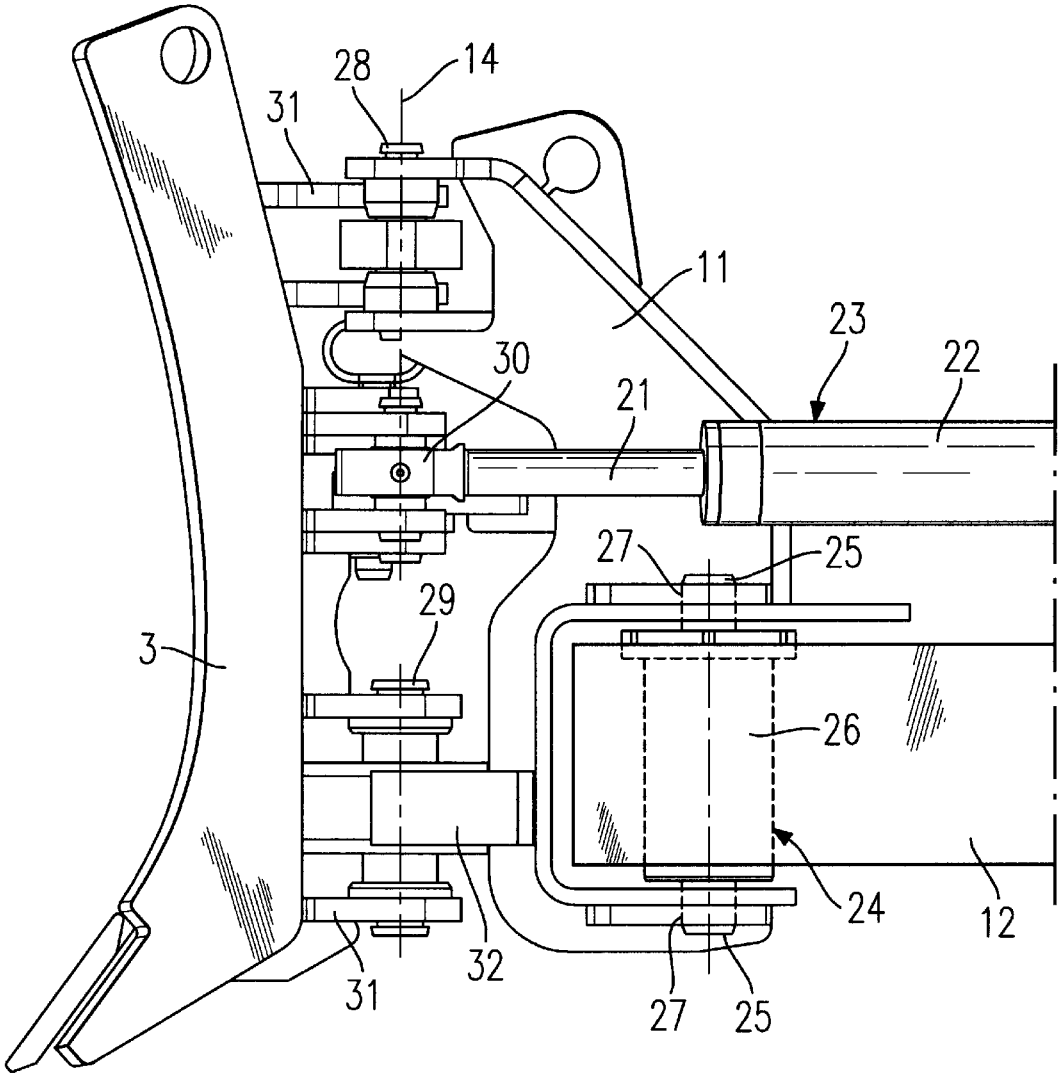
FIG. 3 shows a side view of the blade and the components carrying it on a larger scale.

In the area of the securing and blocking device 24, the carrier 11 reaches around the carrying piece 12 in a U shape, as shown in FIG. 3.

Furthermore, according to FIG. 3, the axis 14 comprises two bearing pins 28 and 29 arranged at a distance from each other. Their fixing to the carrier 11 and their connection on the blade side is known to those skilled in the art and illustrated in practical terms in FIG. 3.

Laterally on the outside and, in terms of height, between the two bearing pins 28 and 29, there are attachment points 30 for the free ends of the piston rods 21 of the two hydraulic devices 23 (FIGS. 3 and 4). Carrying lugs 31 arranged on the blade side are also provided in accordance with the exemplary embodiment, in order to produce both the mounting on the bearing pins 28 and 29 and also with the hydraulic devices 23 in the area of the attachment points 30. In this case, the carrier 11 can also reach in a U shape around two carrying lugs 31 on the blade side, or it is located with a projection 32 between two carrying lugs 31 on the blade side.

In order to achieve an optimum oblique position of the blade 3 in relation to the vehicle longitudinal axis 13, the attachment point 33 on the blade side for the piston rod 21 which can be extended to the maximum during the oblique setting and belonging to the hydraulic device 23 (FIG. 5) can be moved or at least partly detached. In practical terms, the attachment point 33 for the free end of one piston rod 21 is located on a pivotable link 34 which can be blocked in its working position on the lug 31, for example by a pin 35. In order to set the blade 3 obliquely, the link 34 is unlocked, so that the freedom of the blade 3 to move becomes somewhat greater than when the link 34 is locked.

As the blade 3 is being set obliquely, the hydraulic devices 23 serving to adjust the blade 3 also change their position in relation to the construction vehicle 1. They likewise assume an oblique position, as illustrated in FIG. 5.

The carrying piece 12 is a component that projects on the vehicle frame 5. It can be arc-shaped (FIG. 5) and, together with the cheeks 16, have a basic shape somewhat like a U.

A conventional blade 3 has, for example, a size corresponding to the illustrations in FIGS. 2, 4 and 5. In principle, however, a blade 3' can also be somewhat larger and, for this purpose, can be provided with extension parts 40 and 41 which can be laterally flange-mounted. Both the center piece 42 of the blade 3' and the two extension parts 40 and 41 each have flange pieces 43 at their mutually facing ends, with the aid of which they can be connected to one another. For this purpose, use can be made of screws (not illustrated) and fixing openings 44 provided in the flange pieces 43. Because of the possibility of arranging the blade 3 or 3' extremely obliquely in relation to the construction vehicle for the purpose of transport, it is therefore also possible to provide a blade 3' whose width can be varied as required.

What is claimed is:

1. A construction vehicle comprising a vehicle frame (5), a carrier (11) connected to the vehicle frame, a working appliance (2) mounted on the carrier (11) such that the working appliance can pivot about a vertical axis (14), wherein the carrier is connected to the vehicle frame such that the carrier can pivot in a vertical direction about a horizontal axis (17) and can pivot about an upright adjustment axis (15) parallel to the vertical axis (14), hydraulic devices arranged to selectively pivot the working appliance and the carrier, and a blocking device that selectively blocks and releases the ability of the carrier (11) to pivot about the adjustment axis (15), wherein a position of the vertical axis (14) about which the working appliance (2) can pivot is adjustable in a lateral direction between a vertical longitudinal mid-plane running along a vehicle longitudinal axis (13) of the vehicle and a longitudinal plane running at a distance from and parallel to the longitudinal mid-plane.

2. The construction vehicle according to claim 1, wherein the working appliance is a blade.

3. The construction vehicle according to claim 1, wherein the adjustment axis arranged displaced away from the longitudinal mid-plane.

4. The construction vehicle according to claim 1, wherein the blocking device comprises a hydraulic device (26).

5. The construction vehicle according to claim 4, wherein the hydraulic device (26) comprises at least one hydraulically movable pin (25) and a retaining opening (27) for accommodating the pin (25) in a blocking position.

6. The construction vehicle according to claim 1, wherein the hydraulic devices include two hydraulic devices to pivot the working appliance (2) about the vertical axis (14), wherein the two hydraulic devices (23) each comprise a piston rod (21) and a cylinder (22) and are attached respectively on opposite sides of the longitudinal mid-plane, at one end to the vehicle frame and at another end to the working appliance, and wherein an attachment point (33) of one of the two hydraulic devices (23) is at least partly detachable in order to adjust the working appliance (2).

7. The construction vehicle according to claim 1, further comprising a projecting carrying piece (12) connected to the vehicle frame to pivot about the horizontal axis (17), wherein the carrier (11) is mounted on the projecting carrying piece (12), and thereby connected to the vehicle frame (5) via the projecting carrying piece (12).

8. The construction vehicle according to claim 7, wherein the carrying piece (12) is arc-shaped.

9. The construction vehicle according to claim 1, wherein the working appliance (2) is attached centrally to the carrier (11), and the carrier (11) is mounted such that it can pivot off-center in relation to the vehicle frame (5).

10. The construction vehicle according to claim 1, wherein the working appliance (2) is a blade (3) comprising a center piece (42) and extension parts (40, 41) removably secured laterally on lateral ends of the center piece.

11. A construction vehicle comprising a vehicle frame (5), a carrier (11) connected to the vehicle frame, a working appliance (2) mounted on and attached centrally to the carrier (11) such that the working appliance can pivot about a vertical axis (14), wherein the carrier (11) is mounted on the vehicle frame (5) such that the carrier can pivot in a vertical direction about a horizontal axis (17) and the carrier can pivot off-center in relation to the vehicle frame (5), and hydraulic devices (20, 23) arranged to selectively pivot the working appliance and the carrier, wherein a position of the vertical axis (14) about which the working appliance (2) can pivot is adjustable in a lateral direction between a vertical longitudinal mid-plane running along a vehicle longitudinal axis (13) of the vehicle and a longitudinal plane running at a distance from and parallel to the longitudinal mid-plane.

* * * * *

UNITED STATES PATENT AND TRADEMARK OFFICE

CERTIFICATE OF CORRECTION

PATENT NO. : 6,719,066 B2
DATED : April 13, 2004
INVENTOR(S) : Haringer

It is certified that error appears in the above-identified patent and that said Letters Patent is hereby corrected as shown below:

Column 4,
Line 60, after "axis", insert -- (15) is --;

Column 6,
Line 2, after "blade", replace "(3)" by -- (3') --.

Signed and Sealed this

Twenty-seventh Day of July, 2004

JON W. DUDAS
*Acting Director of the United States Patent and Trademark Office*